US008197032B2

(12) United States Patent
Kim et al.

(10) Patent No.: US 8,197,032 B2
(45) Date of Patent: Jun. 12, 2012

(54) THERMAL INKJET PRINTHEAD

(75) Inventors: Tae-kyun Kim, Seongnam-si (KR); Chang-shin Park, Seongnam-si (KR); Myung-song Jung, Gunpo-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1171 days.

(21) Appl. No.: 11/972,779

(22) Filed: Jan. 11, 2008

(65) Prior Publication Data

US 2008/0303874 A1 Dec. 11, 2008

(30) Foreign Application Priority Data

Jun. 5, 2007 (KR) ..... 10-2007-0055262

(51) Int. Cl.
*B41J 2/05* (2006.01)

(52) U.S. Cl. ..... 347/65

(58) Field of Classification Search ..... 347/65, 347/61–64, 54, 56, 40, 42, 44, 47, 20
See application file for complete search history.

(56) References Cited

U.S. PATENT DOCUMENTS 6,113,221 A 9/2000 Weber
7,320,513 B2 * 1/2008 Kim et al. ..... 347/65

FOREIGN PATENT DOCUMENTS

KR 1999-010250 3/1999
KR 10-2006-0038275 5/2006

OTHER PUBLICATIONS

KR Notice of Allowance issued Jan. 30, 2012 in KR Patent Application No. 10-2007-0055262.

* cited by examiner

*Primary Examiner* — Kristal Feggins
(74) *Attorney, Agent, or Firm* — Stanzione & Kim, LLP

(57) ABSTRACT

A thermal inkjet printhead that includes a substrate, a chamber layer stacked on the substrate, an ink chamber formed in the chamber layer, a heater to heat ink filled in the ink chamber to generate bubbles, and a nozzle layer stacked on the chamber layer, and including a nozzle formed in the nozzle layer, wherein a ratio of the volume of ink ejected through the nozzle with respect to the sum of the volumes of the ink chamber and the nozzle is in the range of approximately 40 to 60%.

14 Claims, 2 Drawing Sheets

THERMAL INKJET PRINTHEAD

CROSS-REFERENCE TO RELATED APPLICATIONS

This application claims the benefit of Korean Patent Application No. 10-2007-0055262, filed on Jun. 5, 2007, in the Korean Intellectual Property Office, the disclosure of which is incorporated herein by reference in its entirety.

BACKGROUND OF THE INVENTION

1. Field of the Invention

The present general invention concept relates to an inkjet printhead, and more particularly, to a thermal inkjet printhead that can improve print quality.

2. Description of the Related Art

Generally, inkjet printers are devices forming an image having a predetermined color on a printing medium by ejecting micro ink droplets, which are fed by inkjet printheads attached to ink cartridges, onto a desired region of the printing medium. Such inkjet printers can be classified as shuttle type inkjet printers in which inkjet printheads print by moving in a perpendicular direction to the transfer direction of a printing medium, and line printing type inkjet printers including array printheads having a size corresponding to the width of a printing medium, and which have been recently developed in order to realize high-speed printing. In the line printing type inkjet printers, a plurality of inkjet printheads are arranged on the array printheads in a predetermined pattern, and the line printing type inkjet printers print when the array printheads are fixed and as the printing medium is transferred through the printers. Thus, the line printing type inkjet printers are highly preferred since such printers can print at high speed.

Depending on the ink ejecting mechanism, inkjet printheads can be classified into two types: thermal inkjet printheads and piezoelectric inkjet printheads. In more detail, a thermal inkjet printhead generates bubbles in the ink using a heat source, and ejects ink droplets using the expansion of the bubbles. On the other hand, a piezoelectric inkjet printhead ejects ink droplets using pressure that is applied to the ink by deforming a piezoelectric material.

FIG. 1 is a partially cutaway perspective view of a conventional thermal inkjet printhead. Referring to FIG. 1, the conventional thermal inkjet printhead has a structure in which a chamber layer 20 and a nozzle layer 30 are sequentially stacked on a substrate 10. An ink feed hole 11, to feed ink, is formed in the substrate 10. An ink chamber 22 that can be filled with ink fed through the ink feed hole 11 and a restrictor 24 connecting the ink chamber 22 to the ink feed hole 11 are formed in the chamber layer 20. A nozzle 32, for ejecting ink, is formed in the nozzle layer 30. A heater 14, to heat ink filled in the ink chamber 22 to generate bubbles, is formed on the substrate 10 in the ink chamber 22. In the conventional thermal inkjet printhead having the above structure, when electric current is supplied to the heater 14, ink adjacent to the heater 14 is heated and bubbles are generated and expanded. Due to the expansion of the bubbles, the ink filled in the ink chamber 22 and the nozzle 32 is ejected from the ink chamber 22 through the nozzle 32 in the form of droplets. Thereafter, new ink is fed from the ink feed hole 11 into the ink chamber 22 through the restrictor 24.

In the conventional thermal inkjet printhead of FIG. 1, only some of the ink filled in the ink chamber 22 and the nozzle 32 is ejected from the ink chamber 22 during ink-ejection, while the ink that remains in the ink chamber 22 and the nozzle 32 stays in the heated state. The remaining heated ink is mixed with the new ink fed through the ink feed hole 11 in order to be ejected in a next operation. However, the mixed ink has a higher temperature than that of the ink initially filled in the ink chamber 22 and the nozzle 32, and is ejected from the ink chamber 22 through the nozzle 32 during the ink-ejection during the next operation. As the ink-ejection proceeds, the temperature of the ink filled in the ink chamber 22 and the nozzle 32 is increased. Accordingly, the temperature of the ejected ink is increased. Generally, the higher the temperature of the ink, the lower the viscosity of the ink, thereby further increasing the quantity of the ejected ink. Accordingly, in the conventional thermal inkjet printhead having the above structure, as a printing operation proceeds, a degradation of print quality may occur, in which the density of an image that is to be eventually printed becomes higher than that of an image initially printed.

In addition, in FIG. 1,for the conventional thermal inkjet printhead having the above structure, the temperature of the substrate 10 is increased because some of heat generated by the heater 14 continuously accumulates on the substrate 10 around the location on which the heater 14 is formed on the substrate 10 during a printing job. The heat-accumulation phenomenon may seriously occur in the recently developed thermal inkjet printhead operating at a high frequency, which has been recently developed in order to realize high-speed printing. Likewise, when the temperatures of the substrate 10 and ink are increased as a printing operation proceeds, oxygen, nitrogen, carbon dioxide or the like dissolved in the ink evaporates, and thus, air bubbles may be generated. In addition, these air bubbles generated by the heater 14 may not completely disappear, and thereby may remain in the form of minute bubbles. The air bubbles and remaining bubbles deteriorate the ejection property of ink, thereby deteriorating the print quality of an image.

SUMMARY OF THE INVENTION

The present general invention concept provides a thermal inkjet printhead that can improve print quality.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a thermal inkjet printhead including a substrate, a chamber layer stacked on the substrate including an ink chamber formed in the chamber layer, a heater to heat ink filled in the ink chamber to generate bubbles, a nozzle layer stacked on the chamber layer, and including a nozzle formed in the nozzle layer, wherein a ratio of the volume of ink ejected through the nozzle with respect to the sum of the volumes of the ink chamber and the nozzle is in the range of 40 to 60%.

The thickness of the chamber layer may be in the range of 6.5 to 13 μm. An ink feed hole, to feed ink into the ink chamber, may be formed in the substrate, and a restrictor that connects the ink feed hole to the ink chamber may be further formed in the chamber layer.

The heater may be formed on the substrate in the ink chamber, and a passivation layer may be further formed on the substrate so as to cover the heater.

The foregoing and/or other aspects and utilities of the present general inventive concept may also be achieved by providing an inkjet printhead including an ink chamber formed in a chamber layer, a nozzle formed in a nozzle layer, wherein a ratio of the volume of ink ejected through the nozzle with respect to the sum of the volumes of the ink chamber and the nozzle is in the range of about 40 to 60%.

A thickness of the chamber layer is in the range of 6.5 to 13 μm, and a heater is formed in the ink chamber.

The foregoing and/or other aspects and utilities of the present general inventive concept may also be achieved by providing an inkjet cartridge including an inkjet printhead having an ink chamber formed in a chamber layer, and a nozzle formed in a nozzle layer, wherein a ratio of a volume of ink ejected through the nozzle with respect to a sum of volumes of the ink chamber and the nozzle is in a range of about 40 to 60%.

The inkjet printhead may further include a heater formed therein.

The foregoing and/or other aspects and utilities of the present general inventive concept may also be achieved by providing an inkjet printer including an inkjet printhead having an ink chamber formed in a chamber layer, and a nozzle formed in a nozzle layer, wherein a ratio of the volume of ink ejected through the nozzle with respect to the sum of the volumes of the ink chamber and the nozzle is in the range of about 40 to 60%.

The inkjet printer may further include a heater formed in the inkjet printhead.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
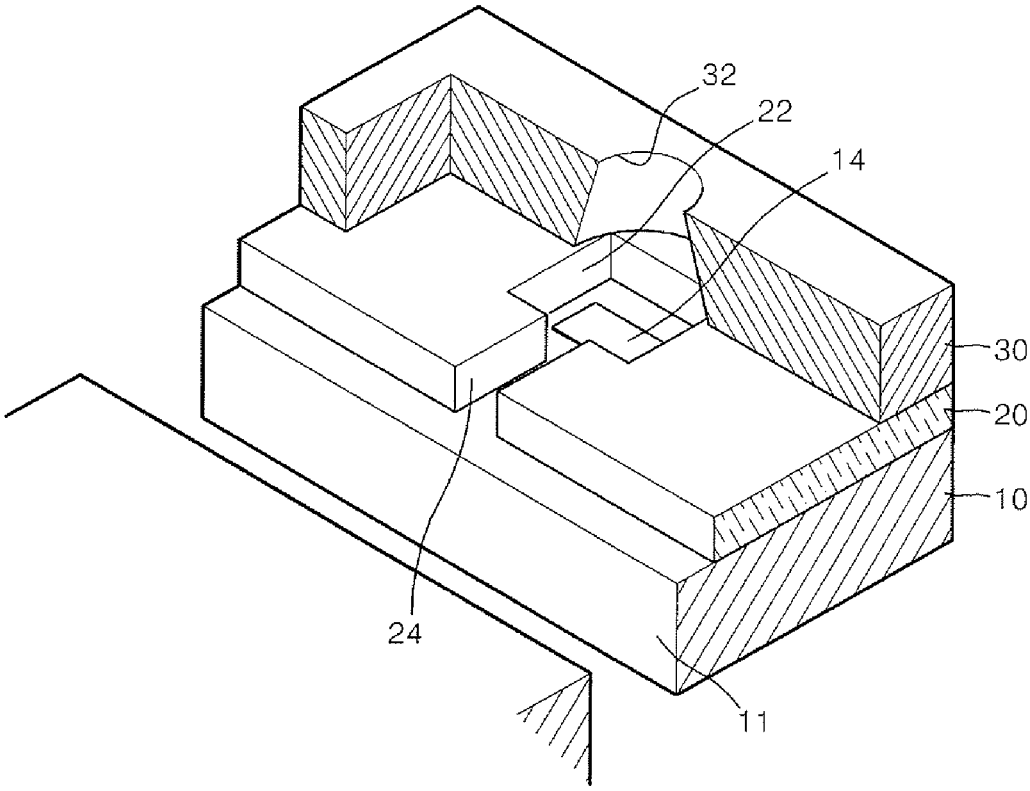
FIG. 1 (PRIOR ART)
FIG. 1 is a partially cutaway perspective view illustrating a conventional thermal inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

To reduce negative effects as described in the background of the present general inventive concept, it is advantageous that a large part of ink filled in an ink chamber and a nozzle be ejected through the nozzle. In embodiments of the present general inventive concept, when ink having a high temperature and which remains in an ink chamber and the nozzle after ink-ejection is mixed with new ink fed through an ink feed hole, the temperature of the mixed ink can be reduced.

The present embodiment estimates the temperature of the mixed ink based on the following Table 1 when the ink remaining in the ink chamber and the nozzle after ink-ejection is mixed with the new ink fed through the ink feed hole.

TABLE 1

| Total Volume (pl) | Volume of Ejected Ink (pl) | Volume of Ink Remaining in Ink Chamber and Nozzle (pl) | Temperature of Ejected Ink (° C.) | Temperature of Mixed Ink (° C.) |
|---|---|---|---|---|
| 20 | 5 | 15 | 50 | 43.8 |
| 15 | 5 | 10 | 50 | 41.7 |
| 10 | 5 | 5 | 50 | 37.5 |
| 5 | 5 | 0 | 50 | 25 |

As illustrated in Table 1, a total volume (pl) denotes the sum of the volume of ejected ink and the volume of ink remaining in the ink chamber and the nozzle, and is determined according to the sizes of the ink chamber and the nozzle. The volume of ejected ink (pl) and the temperature of ejected ink (° C.) respectively denote the volume and the temperature of ink ejected through the nozzle during ink-ejection. The volume of ejected ink is determined according to the size of a heater. When ink, which remains in the ink chamber and the nozzle after ink-ejection, is mixed with new ink fed through the ink feed hole, the temperature of the mixed ink is the temperature of the ink prepared for ejection. It is assumed that the volume and the temperature of the ejected ink are respectively 5 pl and 50(° C.) and that the temperature of the new ink fed through the ink feed hole is about 25(° C.).

Referring to Table 1, when the total volumes are respectively 20 pl, 15 pl, 10 pl and 5 pl, the volume of the ink remaining in the ink chamber and the nozzle is 15 pl, 10 pl, 5 pl and 0 pl, respectively. Accordingly, when the ink remaining in the ink chamber and the nozzle is mixed with the new ink fed through the ink feed hole, the temperatures of the mixed ink are respectively 43.8(° C.), 41.7(° C.), 37.5(° C.) and 25(° C.). From this result, it can be seen that the temperature of the mixed ink is remarkably changed as the ratio of the volume of the ejected ink to the total volume of ink is accordingly changed. When more printing duty and continuous printing of sheets is required, a higher temperature of the ejected ink, which is assumed to be 50(° C.), is also required.

Based on the above result, the present general inventive concept optimizes the shape of an inkjet printhead (e.g., the ratio of the volume of the ejected ink with respect to the total volume of ink, the thickness of a chamber layer, etc.) in order to prevent degradation of print quality. To achieve this, the print quality according to the ratio of the volume of the ejected ink with respect to the total volume has been investigated through the following experiment.

Figure 2:
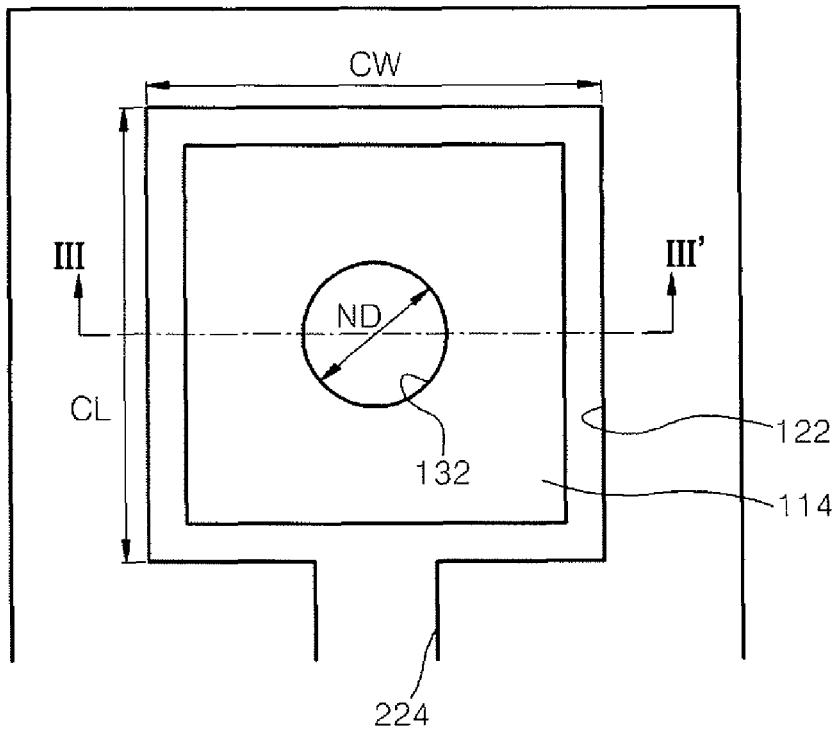
FIG. 2 is a plan view illustrating a thermal inkjet printhead according to an exemplary embodiment of the present general invention concept.
Figure 3:
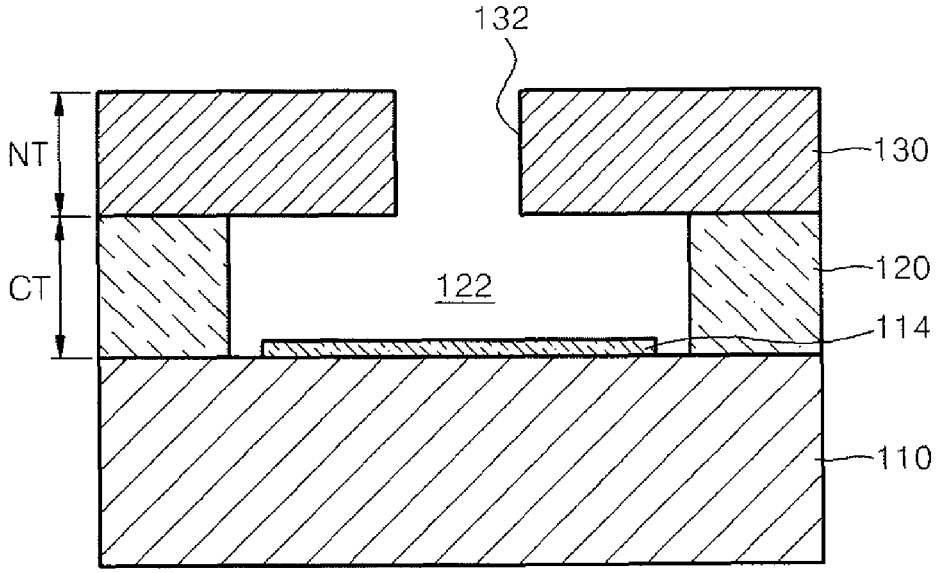
FIG. 3 is a cross-sectional view illustrating the thermal inkjet printhead taken along line III-III' of FIG. 2.

FIG. 2 is a plan view illustrating a thermal inkjet printhead according to an embodiment of the present general inventive concept. FIG. 3 is a cross-sectional view of the thermal inkjet printhead of FIG. 2 taken along line III-III'.

Referring to FIGS. 2 and 3, the thermal inkjet printhead has a structure in which a chamber layer 120 and a nozzle layer 130 are sequentially stacked on a substrate 110. A silicon substrate may generally be used as the substrate. An ink feed hole (not shown), to feed ink, may be formed through the substrate 110. Also, the chamber layer 120 in which an ink chamber 122 is formed is stacked on the substrate 110, and ink fed through the ink feed hole fills into the ink chamber 122. A restrictor 224, functioning as a path connecting the ink feed hole to the ink chamber 122, may further be formed in the chamber layer 120. In FIG. 2, CL and CW respectively denote the length and the width of the ink chamber 122, and in FIG. 3, CT denotes the thickness of the chamber layer 120. A heater 114, to heat ink filled into the ink chamber 122 in order to generate bubbles, is formed on the substrate 110 in the ink chamber 122. The heater 114 may be formed of a heating resistor formed of, for example, a tantalum-aluminum alloy, tantalum nitride, titanium nitride, or tungsten silicide. Although not illustrated, a passivation layer may be further formed on the substrate 110 in order to prevent the heater 114 from contacting ink, thereby preventing corrosion and oxidization of the heater 14. The passivation layer may be formed of, for example, silicon nitride or silicon oxide. The nozzle layer 130, including a nozzle 132 formed therein and through which ink is ejected, is stacked on the chamber layer 120. In FIG. 2, ND denotes the diameter of the nozzle 132, and in FIG. 3, NT denotes the thickness of the nozzle layer 130.

In FIG. 3, in the thermal inkjet printhead, when ink is filled in the ink chamber 122 and the nozzle 132 and electric current is supplied to the heater 114, ink adjacent to the heater 114 is heated,thereby generating and expanding ink bubbles. Due to the expansion of the bubbles, the ink filled in ink chamber 122 and the nozzle 132 is ejected out of the ink chamber 122 through the nozzle 132 in the form of droplets. Then, new ink is fed from the ink feed hole into the ink chamber 122 through the restrictor 224.

An inkjet printer (not shown) includes an ink cartridge (not shown) to which the thermal inkjet printhead can be attached. An ink storage area, to store ink to be fed through the ink feed hole of the thermal inkjet printhead, is provided inside the ink cartridge.

Table 2 shows the result of printing jobs according to the thickness CT of the chamber layer of the thermal inkjet printhead. In this experiment, the thicknesses of the chamber layers 120 of four models (i.e. A, B, C and D) are respectively 13 μm, 10 μm, 7.5 μm, and 6.5 μm. In the experiment, the thickness NT of the nozzle layer 130 and the diameter ND of the nozzle 132 are respectively 11 μm and 12 μm. The length CL and the width CW of the ink chamber 122 are respectively 27 μm and 27 μm. The size of the heater 114 is 23 μm×23 μm. The thickness of the passivation layer formed so as to cover the heater 114 is 6000 μm. In addition, a driving voltage of 10 V is applied to the heater 114 for 0.77 μs, thereby resulting in a driving energy of 1.2 μJ.

TABLE 2

| Model | Total Volume (pl) | Volume of Ejected Ink (pl) | Volume of Ejected Ink/Total Volume (%) | Print Quality |
|---|---|---|---|---|
| A(CT = 13 μm) | 10.7 | 3.7 | 34.5 | WORST |
| B(CT = 10 μm) | 8.5 | 3.7 | 43.4 | GOOD |
| C(CT = 7.5 μm) | 6.7 | 3.7 | 55.1 | GOOD |
| D(CT = 6.5 μm) | 6.0 | 3.7 | 61.9 | BAD |

The total volume (pl) illustrated in Table 2 denotes the sum of the volumes of the ink chamber 122 and the nozzle 132. The volume of ejected ink (pl) denotes the volume of ink ejected through the nozzle 132 during ink-ejection.

According to this experiment, when the ratio of the volume of ejected ink with respect to the total volume is about 40% or more, degradation of print quality does not occur. In other words, the density of an image printed later is higher than that of an image printed initially. Meanwhile, in the instance of the model D (i.e., when the thickness CT of the chamber layer 120 is 6.5 μm) in Table 2, degradation of print quality does not occur. In other words, the density of a later printed image is higher than an initial printed image. However, the refill property of ink, for the ink that flows into the ink chamber 122 after ink-ejection, degrades since the thickness CT of the chamber layer 120 is reduced. Thus, a degradation of print quality occurs due to unstable ink-ejection. Thus, when the thickness of the chamber layer is 6.5 μm or less, the print quality may be further degraded.

In addition, the chamber layer 120 is formed using a method in which applying, exposing and developing of a photosensitive material are performed. However, when the thickness CT of the chamber 130 is 13 μm or more, ink chamber patterns may be incorrectly formed because light is not transmitted to the depth corresponding to the thickness CT of the chamber layer 120 during the exposing for forming ink chamber patterns. Thus, if the ink chamber 122 is incorrectly formed having an undesired shape, an unstable ink-ejection may occur.

After considering all the factors of this experiment, the resulting ratio of the volume of ejected ink with respect to the total volume of the ink chamber 122 and the nozzle 132 is in the range of about 40 to 60% so as to prevent the degradation of the print quality (see Table 2). In addition, the thickness CT of the chamber layer is in the range of 6.5 to 13 μm. In the present general inventive concept, the length CL and the width CW of the ink chamber 122, the thickness NT of the nozzle layer 130, the diameter ND of the nozzle 132, and the size of the heater 114 can be varied.

As described above (see Table 2), according to the present general inventive concept, the ratio of the volume of ejected ink with respect to the total volume of the ink chamber 122 and the nozzle 132 is maintained in the range of about 40 to 60%, and thus the print quality can be improved. Thus, the degradation of print quality, in which the density of an image is changed according to pages, can be prevented. The refill property of ink flowing into the ink chamber 122 is improved. Thus, a driving frequency can be increased. The ink chamber 122 is correctly formed to have a desired shape, and thus the degradation of the print quality can be prevented due to unstable ink-ejection. In addition, by preventing the occurrence of air bubbles or remaining bubbles, which are conventional problems, the ejection property of ink can be improved, thereby improving the reliability of the thermal inkjet printhead.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A thermal inkjet printhead comprising:

a substrate;

a chamber layer stacked on the substrate, and including an ink chamber formed in the chamber layer;

a heater to heat ink filled in the ink chamber to generate bubbles; and a nozzle layer stacked on the chamber layer, and including a nozzle formed in the nozzle layer, wherein a ratio of the volume of ink ejected through the nozzle with respect to the sum of the volumes of the ink chamber and the nozzle is in the range of approximately 40 to 60%.

2. The thermal inkjet printhead of claim 1, wherein a thickness of the chamber layer is in the range of 6.5 to 13 μm.

3. The thermal inkjet printhead of claim 1, wherein an ink feed hole, to feed ink into the ink chamber, is formed in the substrate.

4. The thermal inkjet printhead of claim 3, wherein a restrictor to connect the ink feed hole to the ink chamber is further formed in the chamber layer.

5. The thermal inkjet printhead of claim 1, wherein the heater is formed on the substrate in the ink chamber.

6. The thermal inkjet printhead of claim 5, wherein a passivation layer is further formed on the substrate so as to cover the heater.

7. An ink cartridge comprising:

an inkjet printhead comprising:

an ink chamber formed in a chamber layer; and a nozzle formed in a nozzle layer, wherein a ratio of a volume of ink ejected through the nozzle with respect to a sum of volumes of the ink chamber and the nozzle is in a range of approximately 40 to 60%.

8. The ink cartridge of claim 7, wherein a thickness of the chamber layer is in the range of 6.5 to 13 μm.

9. The ink cartridge of claim 7, wherein a heater is formed in the ink chamber.

10. The ink cartridge of claim 7, wherein an ink feed hole, to feed ink to the ink chamber, is formed in the substrate.

11. The ink cartridge of claim 9, wherein an ink storage area, to store ink fed through the ink feed hole, is provided inside the ink cartridge.

12. An inkjet printer comprising:

an inkjet printhead comprising:

an ink chamber formed in a chamber layer; and a nozzle formed in a nozzle layer, wherein a ratio of a volume of ink ejected through the nozzle with respect to a sum of volumes of the ink chamber and the nozzle is in a range of approximately 40 to 60%.

13. The inkjet printer of claim 12, wherein the thickness of the chamber layer is in the range of 6.5 to 13 μm.

14. The ink cartridge of claim 12, wherein a heater is formed in the ink chamber.

* * * * *